United States Patent [19]

Trogan

[11] 4,254,947

[45] Mar. 10, 1981

[54] SHEET OVERLAP DEVICE

[75] Inventor: John F. Trogan, Ashland, Wis.

[73] Assignee: C. G. Bretting Mfg. Co. Inc., Ashland, Wis.

[21] Appl. No.: 44,208

[22] Filed: May 30, 1979

[51] Int. Cl.[3] ..... B41L 1/32

[52] U.S. Cl. ..... 270/39

[58] Field of Search ..... 270/39, 40

[56] References Cited

U.S. PATENT DOCUMENTS

| | | | |
|---|---|---|---|
| 2,092,952 | 9/1937 | Campbell | 270/39 |
| 3,490,762 | 1/1970 | Nystrand | 270/39 |
| 4,163,548 | 8/1979 | Nystrand | 270/39 |

*Primary Examiner*—Edward M. Coven
*Assistant Examiner*—A. Heinz
*Attorney, Agent, or Firm*—Sherman Levy

[57] ABSTRACT

A sheet overlap device or apparatus that includes an improved and novel method and means for overlapping of sheets and in particular for overlapping hand towels at high speeds using a vacuum arrangement. The transfer from one vacuum roll to the other is made at the same surface velocity so as to provide better register of the overlap and wherein there will be less likelihood of jamming occurring. The unit includes feed rolls, a fly knife roll, vacuum fed bed roll, pinch or pressure roll, vacuum fed lap roll, vacuum fed tail roll, and retard rolls. In one form of the invention, there is a generally horizontal feed, while in another form of the invention the feed occurs vertically rather than horizontally. By utilizing a vertical rather than a horizontal discharge of the machine, there is the added advantage to gravity helping the discharge from the folding rolls.

6 Claims, 8 Drawing Figures

SHEET OVERLAP DEVICE

BACKGROUND OF THE INVENTION

Field of the Invention

The present invention relates to sheet overlap devices or apparatus, and more particularly to sheet overlap devices for overlapping sheets such as hand towels wherein the overlapping can be accomplished at high speed with the use of vacuum pressure.

In accordance with the present invention, the transfer from one vacuum roll to the other is made at the same surface velocity so as to provide better register of the overlap and wherein there will be less likelihood of jamming occuring.

A primary object of the present invention is to provide a method and means for overlapping sheets such as hand towels wherein hand towels have a "Z" fold with approximately a ⅓ overlap.

A still further object of the present invention is to provide feed overlap devices which in one form of the invention may utilize a horizontal discharge, whereas in a different or alternative arrangement, a vertical rather than a horizontal discharge of the machine is utilized so that there is an advantage to gravity helping the discharge from the folding rolls.

Still another object of the present invention is to provide a sheet overlap method and means which is especially suitable for overlapping hand towels at high speed wherein the lap roll utilizes multiple vacuum holds which pick the towel off of the bed roll and transfer it around to top strippers. Slugs in valves determine the cut-off point of the vacuum holes and the slugs are set to cut off the vacuum as the sheet is stripped from the lap roll. At a predetermined time, vacuum holes in the tail roll pull the back edge of the towel down onto the bottom guide so as to allow the leading edge of the next towel to slide over the top of the tail edge of the towel preceding.

A still further object of the present invention is to provide a method and means for overlapping sheets and in particular for overlapping hand towels wherein the apparatus is ruggedly constructed and efficient to use and which is relatively simple and inexpensive to operate.

Still another object of the present invention is to provide a sheet overlapping apparatus and method that has improved characteristics and advantages as compared to previous sheet overlapping arrangements.

Other objects and advantages of the present invention will become apparent in the following specification when considered in the light of the attached drawings.

DESCRIPTION OF THE PREFERRED EMBODIMENT

Referring in detail to the drawings, and more particularly FIGS. 1 through 7 of the drawings, the numeral 20 indicates generally the sheet overlapping apparatus of the present invention which is shown to comprise a serrated blade fly knife roll 21 that may have a construction generally similar to that shown in prior U.S. Pat. No. 3,709,077. The roll 21 is provided with spaced apart knives or blades 22.

Figure 1:
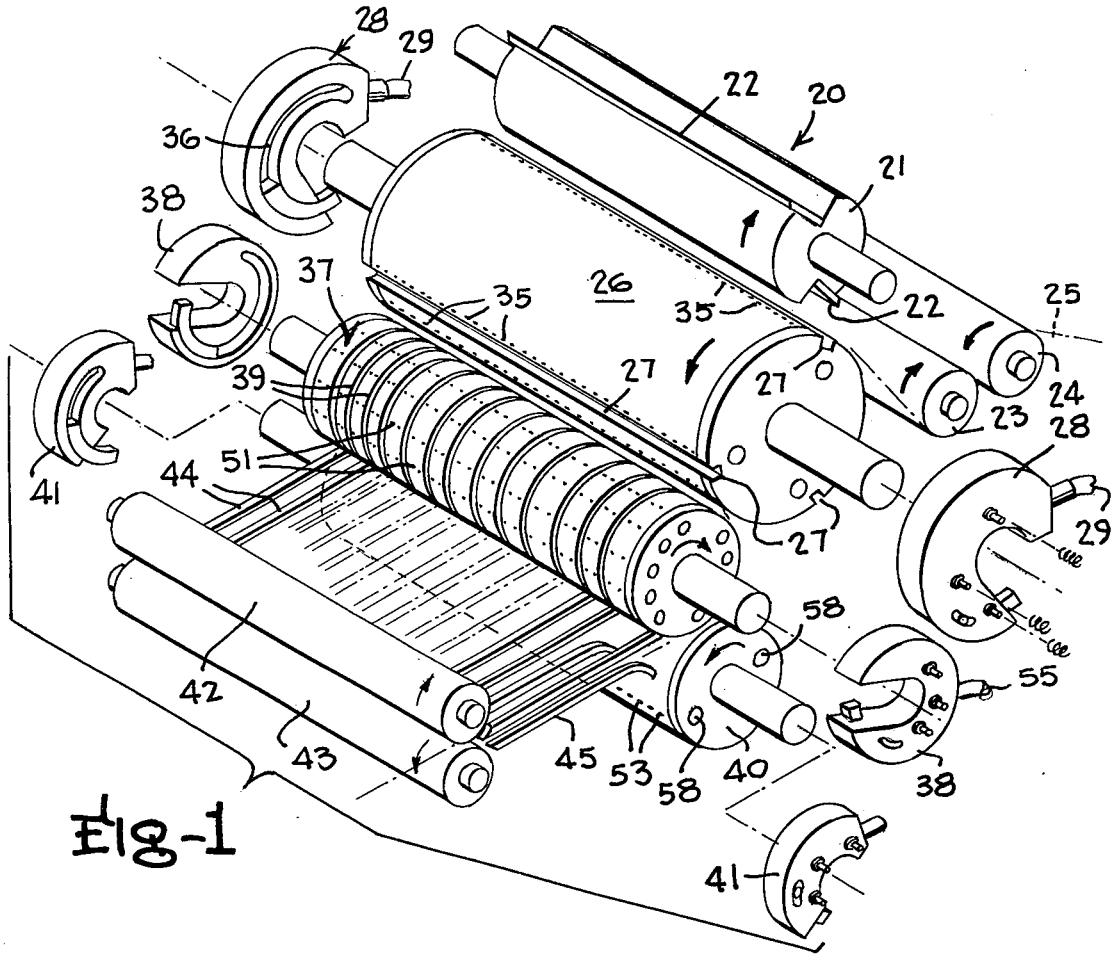
FIG. 1 is a diagrammatic perspective view of the unit or sheet overlapping apparatus of the present invention, with the control valves separated or shown in exploded perspective for clarity of illustration.

The numerals 23 and 24 indicate feed rolls arranged contiguous to each other, and the numeral 25 indicates paper stock which is adapted to be supplied from a suitable source of supply and wherein the paper stock is fed between the feed rolls 23 and 24 as shown in the drawings. In FIG. 1, the arrows indicate the direction of rotation of certain of the rolls.

Figure 3:
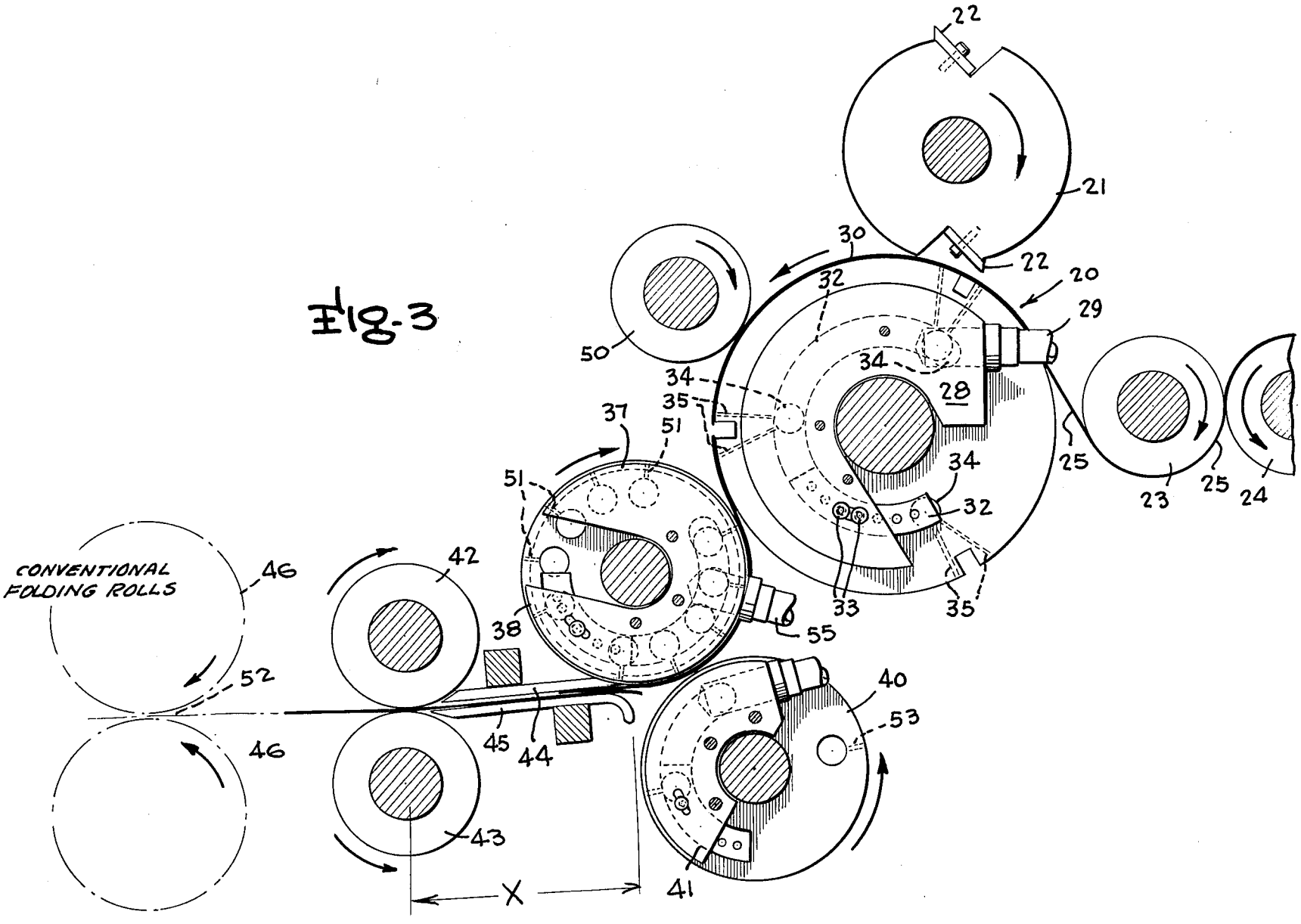
FIG. 3 is an end view of the sheet overlap structure of the present invention, and with parts in section.
Figure 4:
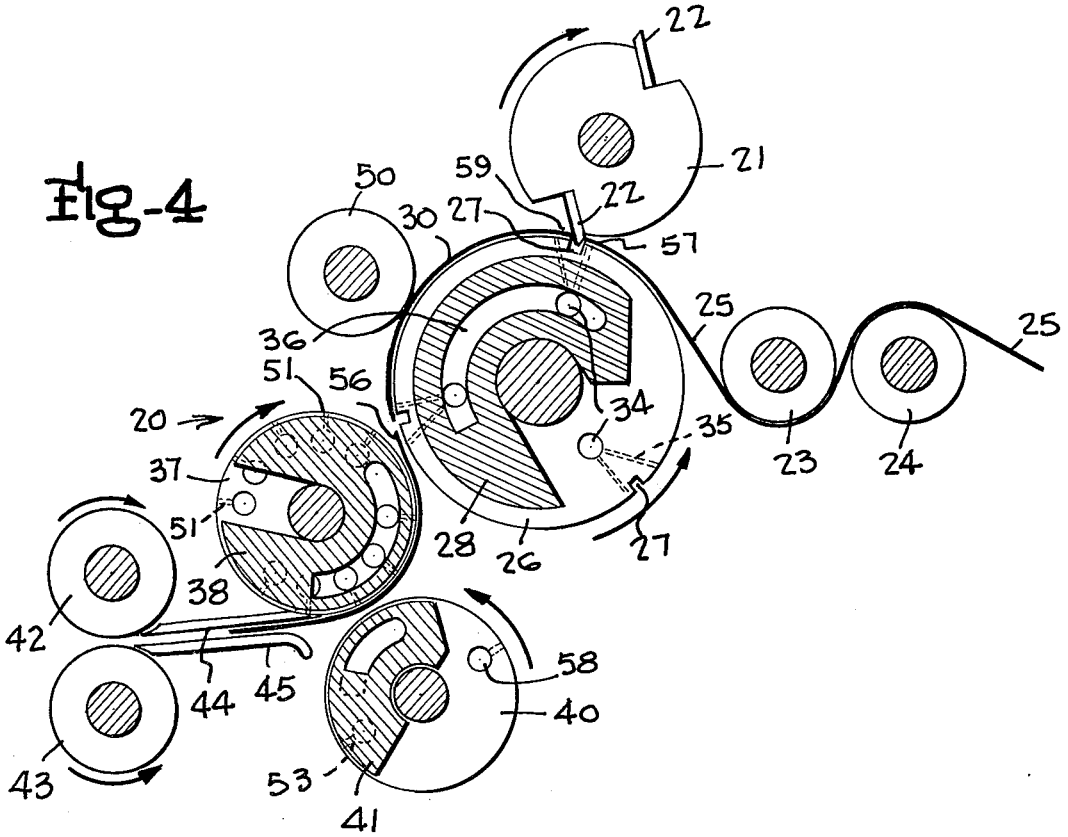
FIGS. 4, 5, 6 and 7 are diagrammatic end views, with parts in section, showing the progression of the web, and illustrating the ports and valve locations in different sequences.

The numeral 26 indicates a bed roll which has spaced apart longitudinally extending slots or grooves 27 therein for coaction with the knives 22 whereby the paper stock or toweling 30 will be cut off in the desired length as shown in FIG. 4. Arranged on the ends of the bed roll 26 are valves 28 which are adapted to be suitably connected to a source of vacuum pressure by means of lines or conduits 29, and the valves 28 may be of conventional construction as, for example, is shown in prior patents such as U.S. Pat. Nos. 3,338,575; 3,489,406; or 3,490,762. The valves 28 are provided with inner annular or arcuate grooves or recesses 36, and curved slugs 32 are adjustably mounted in the recesses 36, and the slugs 32 are adapted to be maintained in their adjusted position by means of securing elements such as screws 33, FIG. 3.

Longitudinally extending channels or holes 34 are provided in the bed roll 26, and ports 35 communicate with the openings or channels 34 for a purpose to be later described.

The numeral 37 indicates a lap roll that has vacuum valves adjacent the ends thereof as indicated by the numeral 38, and the lap roll 37 is provided with a plurality of spaced parallel circular grooves or recesses 39 in its outer periphery as shown in FIG. 1, for example.

There is further provided a tail roll 40 that is arranged adjacent the lap roll 37, and the tail roll 40 has vacuum control valves 41 adjacent the ends thereof.

The numerals 42 and 43 indicate retard rolls. There is further provided top stripper members or elements 44 as well as bottom guide pieces 45, FIG. 3. In FIG. 3 the numeral 46 illustrates diagrammatically conventional folding rolls, and it is to be understood that various types of units can be used at this point in the apparatus, such as that shown in prior U.S. Pat. No. 3,866,905.

Figure 2:
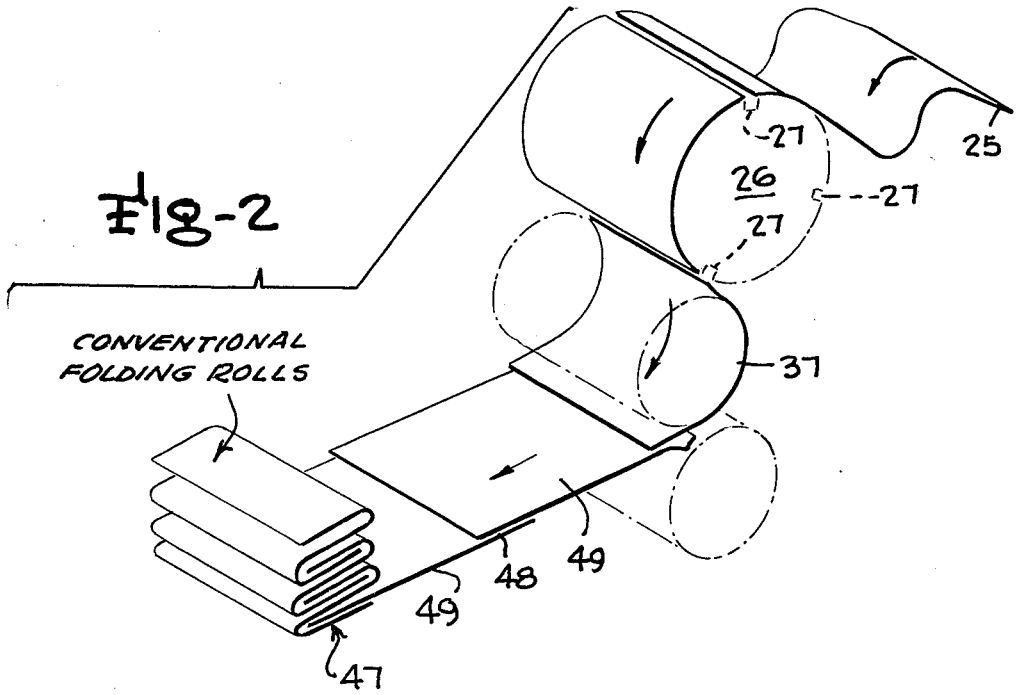
FIG. 2 is a diagrammatic perspective view illustrating the progression of the web or paper toweling through the lapping process.

In FIG. 2, the numeral 47 indicates the final folded paper towels or the like and also in FIG. 2, the numeral 48 shows the approximate point of overlap between the various sheets or paper towels 49.

In FIG. 3, the numeral 50 indicates a pressure or pinch roll.

In accordance with the present invention, there is provided a method and means for overlapping sheets and in particular for overlapping hand towels wherein this overlapping can be accomplished at high speed with the use of vacuum. The present invention has certain important differences and advantages over the devices described in prior patents such as U.S. Pat. Nos. 3,338,575; 3,489,406; and 3,490,762 in that the transfer from one vacuum roll to the other is made at the same surface velocity so as to give better register of the overlap and wherein there will be less likelihood of jamming occurring.

As previously noted and as shown in the drawings, the unit includes feed rolls 23 and 24, the fly knife roll 21, the vacuum fed bed roll 26, the pinch or pressure roll 50, the vacuum fed lap roll 37, the vacuum fed tail roll 40, and retard rolls 42 and 43.

As is well known, one conventional type of hand towel involves a "Z" fold with approximately a ⅓ overlap such as is illustrated in FIGS. 3 and 4 in U.S. Pat. No. 3,489,406.

With further reference to the present invention, the lap roll 37 utilizes multiple vacuum holes 51 and these vacuum holes 51 serve to pick the towel 30 off of the bed roll 26 and transfer the towel around to the top strippers 44 and the top strippers 44 run in approximately ¼ inch widths by ¼ inch deep grooves 39 in the lap roll 37. The lap roll is a two around roll. The vacuum valve 38 supplies the holes 51 with vacuum pressure. The slug such as the slug 32 in the valve 28 determines the cut-off point of the vacuum holes. Similar slugs in the vacuum valves 38 determine the cut-off point of the vacuum holes 51 and these slugs can be set by means of the screws 33 so as to cut off the vacuum as the sheet or toweling is stripped from the lap roll 37.

As the last vacuum hole on the leading two-thirds of the towel is stripped, the leading edge of the towel is fed into the positive nip 52 of the retard rolls 42 and 43 which then take control of the sheet. The distance "X", FIG. 3, is then approximately two-thirds of the total towel. At this same instant, the vacuum hole 53 in the tail roll 40, FIG. 7, pulls the back edge 54 of the towel down onto the bottom guides 45 to allow the leading edge of the next towel to slide over the top of the tail edge of the towel preceding. It is to be noted that on certain stiff paper stock, the tail roll may not be required or needed.

The parts can be made of any suitable material and in different shapes or sizes as desired or required.

It is to be understood that the various accessories can be utilized whenever needed or desired. Further, suitable drive means or mechanisms can be provided for driving the various rolls in the proper direction in conjunction with suitable timing mechanism so that the rolls will rotate or operate at the proper speeds. The vacuum valves are adapted to be connected to vacuum headers by means of flexible vacuum hoses such as the hoses 55. Bearings, brackets, bushings, accessories and the like can be provided or utilized whenever needed.

Figure 5:
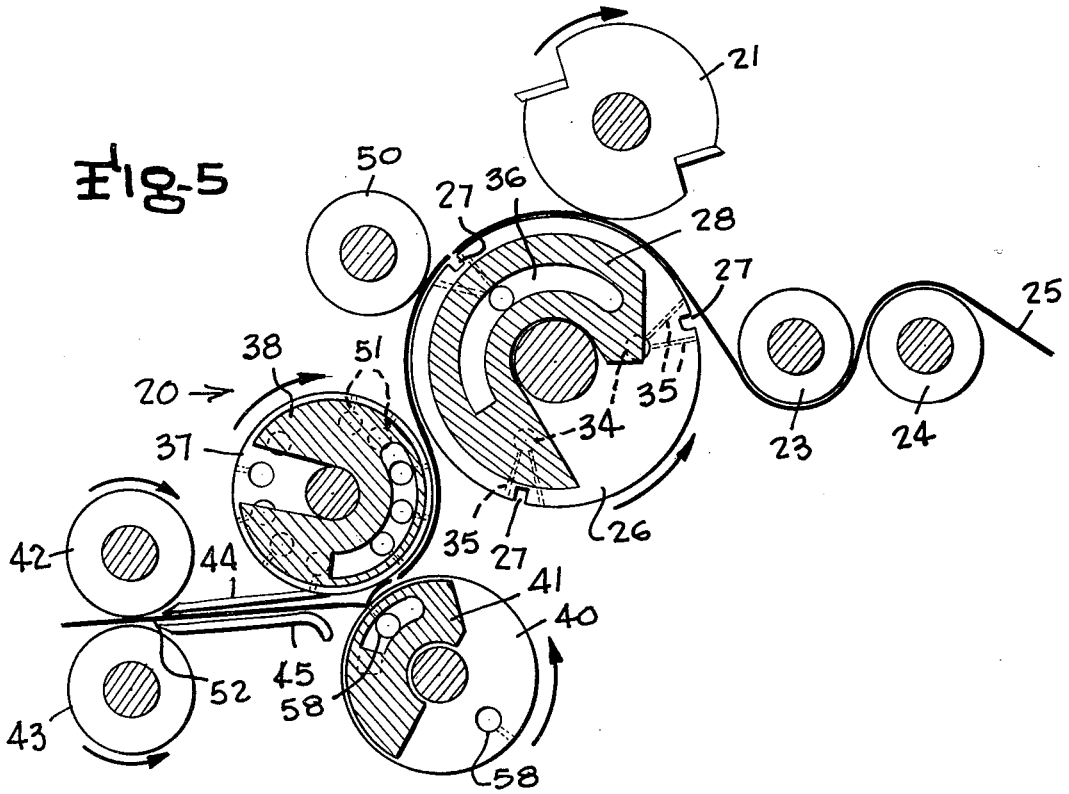

Referring to a figure such as FIG. 4, for example, at the point indicated by the numeral 56 the paper stock or toweling is loose, whereas at the point indicated by the numeral 57, vacuum pressure is being applied to hold the paper toweling in place against the roll 26. As shown in FIG. 5, for example, the tail roll has a pair of diametrically opposed longitudinally extending drilled holes or channels 58. The bed roll 26 has the elongated holes 34 therein so that vacuum pressure can be supplied to the ports 35 in order to selectively hold the paper 30 against the bed roll 26. The parts are constructed and timed so that vacuum pressure is cut off at the proper time so that the paper can drop off of the bed roll 26 and be picked up by the lap roll 37 and this paper then passes between the lap roll 37 and the tail roll 40; the paper subsequently moves between the elements 44 and 45 and this sequence of operations or cycle is repeated whereby by using a conventional folding mechanism, a stack of folded towels 47 is provided that have portions thereof overlapped as previously described in accordance with the present invention. While the present invention has been described in connection with overlapping of paper towels, it is to be understood that the present invention is not limited to the overlapping of paper towels, since it can be used for overlapping sheets of other material besides paper towels.

The slugs such as the slugs 32 can be adjusted in their respective grooves or recesses 36 whereby the grooves in the valves can be increased or decreased in size so that, for example, the amount of vacuum pressure being exerted can be decreased or increased as needed.

As shown in the drawings, the lap roll 37 holds the cut pieces of paper towels and subsequently reverses the direction of the paper towels, and the tail roll 40 selectively holds down the trailing edge of the towel to allow the next towel to overlap the same.

It will be noted that the valves are stationary, whereas the rolls turn. The slugs are adjustably mounted in their respective slots or grooves so that, for example, by loosening the screws 33, the slugs can be adjusted to their desired or proper position, and then the screws 33 can be tightened to maintain the slugs in their proper position, and this permits the vacuum pressure to be controlled from the valves to the various rolls. In FIG. 4, the numeral 59 indicates the point at which the paper towels or stock is cut by the blades or knives 22. As previously noted, as the last vacuum hole on the leading two-thirds of the towel is stripped, the leading edge of the towel is fed into the positive nip of the retard rolls 42 and 43 which then take control of the sheet, and this is to assure that the towels will overlap approximately one-third of the dimension of the towel. The tail roll 40 is constructed and arranged so that an end of the paper towel is grooved due to the provision of the tail roll and the towel is pulled down in the direction as shown in the drawings.

FIG. 1 is a diagrammatic view of the unit and showing the control valves separated for clarity of illustration. FIG. 2 is a diagrammatic view showing the movement or progression of the stock or web through the final lapping process. FIG. 3 is an end view, and FIGS. 4, 5, 6 and 7 are diagrammatic end views showing the progression of the web through the apparatus and also illustrating the position of the ports and valves in different positions during different sequences of operation of the apparatus.

With further reference to the apparatus, the slots 39 provide clearance for the stripper rods 44. As to the tail roll 40, this is important because due to the construction and timing of the tail roll, the loose ends of the towels are grabbed at exactly the right or correct moment and subsequently, the towels are released to bring about the desired action.

Figure 6:
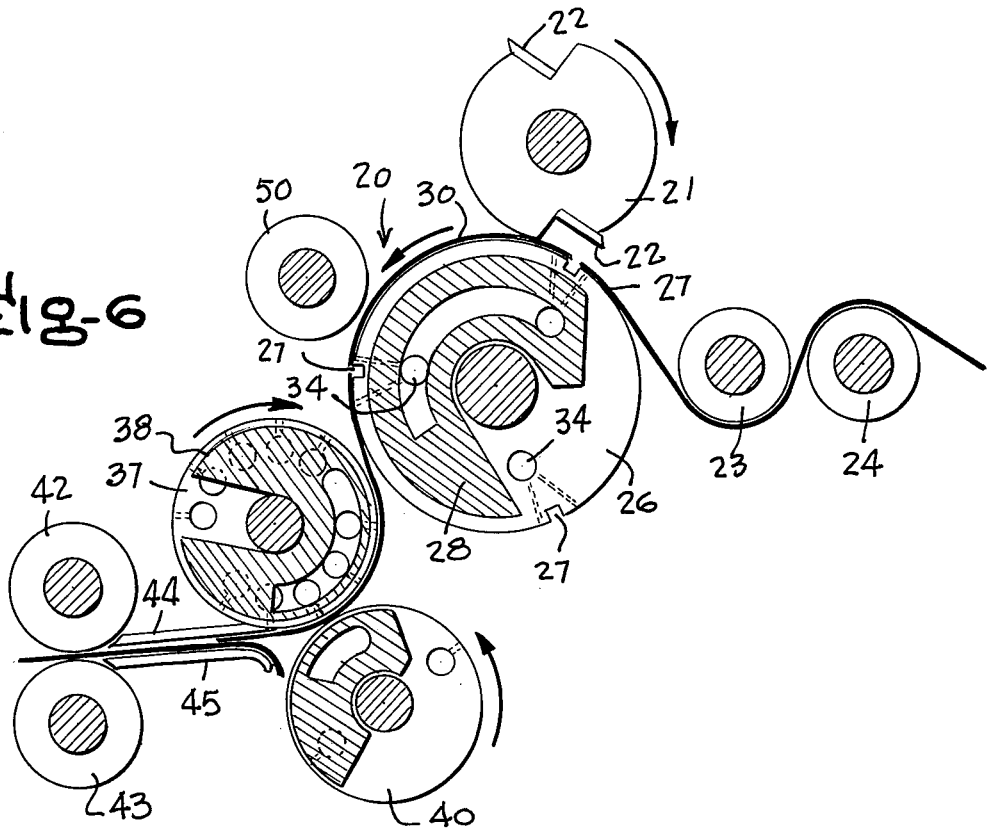
Figure 7:
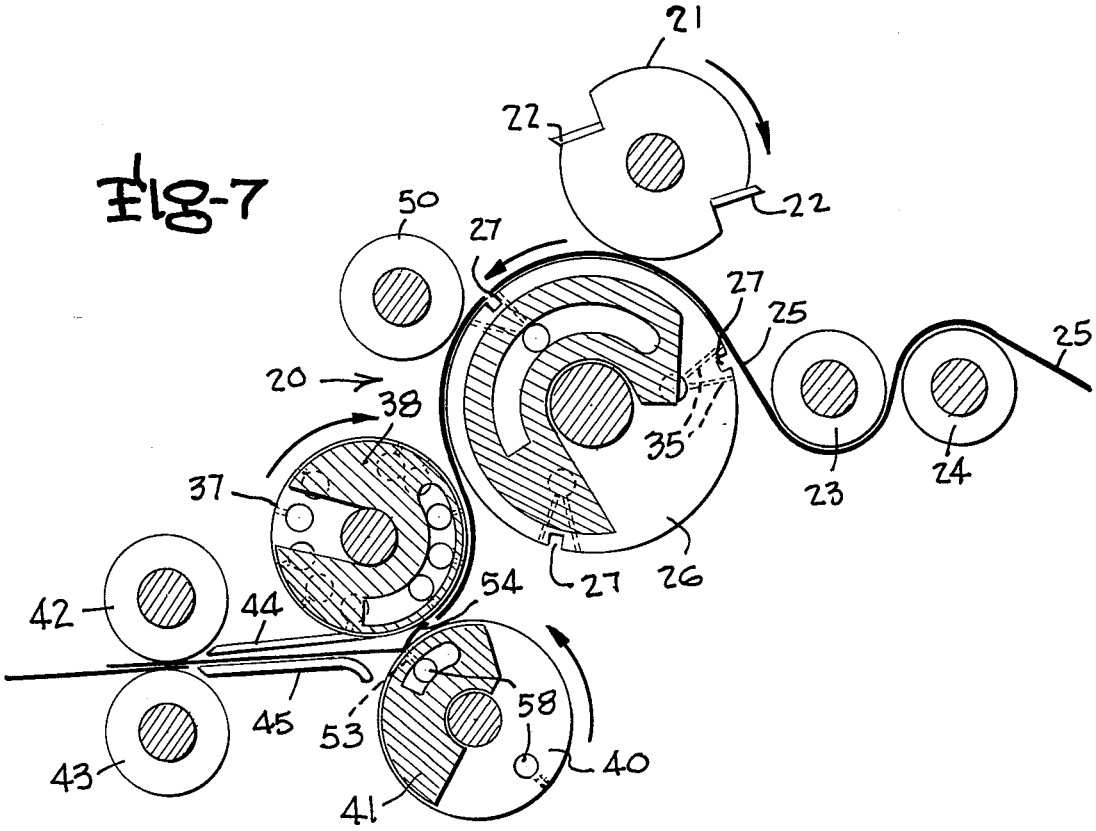

In FIG. 4 there is illustrated diagrammatically a first towel just entering the stripper assembly. In FIG. 5 the tail roll is shown just gripping the trailing end and releasing the same as it is being pulled into its proper position. In FIG. 6, the tail roll has released the trailing end of the towel, and the next towel has passed the same. FIG. 7 is a view showing the parts in a position generally similar to FIG. 5 except that the towels are in the retard rolls, and the tail roll has gripped the trailing edge of the towel. In FIG. 7, the vacuum ports are generally in the same position as illustrated in FIG. 5.

Figure 8:
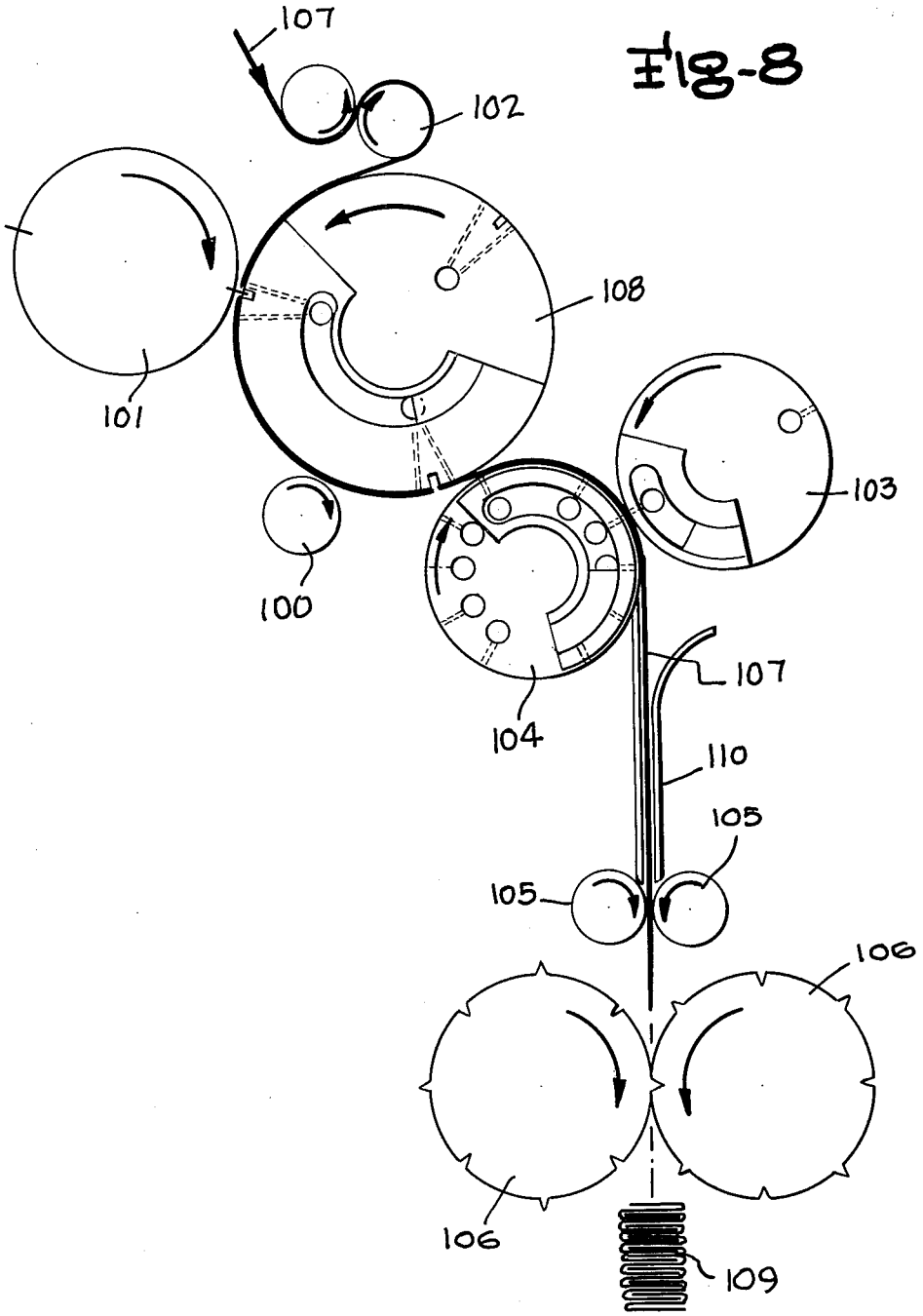
FIG. 8 is a schematic or diagrammatic illustration showing a modified or alternative form of the invention wherein a vertical rather than a horizontal discharge is utilized so that gravity can help the discharge from the folding rolls.

Attention is now directed to FIG. 8 of the drawings wherein there is illustrated a vertical rather than a horizontal discharge of the machine so that there is the advantage of gravity helping the discharge from the folding rolls. The operation and construction of the machine shown in FIG. 8 is generally the same as that previously described in connection with the machine of FIGS. 1 through 7. However, in FIG. 8 there is the added advantage of the gravity helping the discharge from the folding rolls.

In FIG. 8 the numeral 107 indicates the paper stock which is adapted to be supplied from a suitable source of supply, and wherein the paper stock 107 is fed in the direction of arrows between the feed rolls 102. The numeral 101 indicates the serrated blade fly knife roll, and the numeral 108 indicates the bed roll, while the numeral 100 designates the pressure or pinch roll. There is further provided the lap roll 104 and the tail roll 103, and the numeral 105 designates the retard rolls and slitters. The folding rolls are indicated by the numeral 106 and the numeral 109 indicates the final folded paper towels or the like. The bottom guide is indicated by the numeral 110. Thus, FIG. 8 indicates a multi-fold roll machine schematically and the operation and construction of the machine shown in FIG. 8 is generally the same as that shown in FIGS. 1 through 7 except the paper stock 107 feeds vertically rather than horizontally so that there is the added advantage of gravity in the machine of FIG. 8 helping the discharge from the folding rolls 106.

Additional embodiments of the invention in this specification will occur to others and, therefore, it is intended that the scope of the invention be limited only by the appended claims and not by the embodiments described hereinabove. Accordingly, reference should be made to the following claims in determining the full scope of the invention.

What is claimed is:

1. In a sheet overlapping apparatus, which includes oppositely rotating coacting feed rolls, means for introducing stock material between the feed rolls, a rotating bed roll and a rotating fly knife roll mounted adjacent each other, means for rotating said fly knife roll and said bed roll in opposite directions relative to each other, means for directing the stock material between said fly knife roll and said bed roll whereby sections of stock material are severed and cut in to sheets, and a rotating pressure roll cooperatively mounted relative to said bed roll forming a nip therebetween through which the sheets are fed, the improvements include:

vacuum means on said bed roll for holding the sheets thereon, a lap roll contiguous to said bed roll, means for rotating said lap roll and said bed roll in opposite directions relative to each other, and at the same surface velocity, vacuum means on said lap roll for holding the sheets on the periphery of said lap roll to thereby transfer of sheets from said vacuum bed roll to said vacuum lap roll at the same surface velocity, a pair of coacting retard rolls for engaging the sheets therebetween and located immediately downstream of said lap roll relative to the path of movement of the sheets, means to rotate said retard rolls at a speed of approximately two thirds of the speed of said bed roll thereby producing an overlap in said sheets of approximately one-third the length thereof as successive sheets are advanced through said apparatus, and top strippers and bottom guides interposed between said retard rolls and said lap roll to respectively strip sheets from said lap roll and guide the sheets to the retard rolls.

2. The structure as defined in claim 1 and further including a tail roll arranged in spaced parallel cooperative relation with respect to said lap roll, and vacuum means on said tail roll to enhance the advance of sheets through said apparatus.

3. The structure as defined in claim 1 wherein each of said vacuum means includes control valves and means to adjust the same.

4. The structure as defined in claim 1 and further including a pair of oppositely rotating coacting folding rolls.

5. The structure as defined in claim 4 wherein said rolls are disposed so that sheets advance through the machine along a generally horizontal path.

6. The structure as defined in claim 4 wherein the sheets pass to the folding rolls along a generally vertical path so that gravity will help the discharge of the overlapped sheets from the folding rolls.

* * * * *